US007476140B1

(12) United States Patent
Hendrickson

(10) Patent No.: US 7,476,140 B1
(45) Date of Patent: Jan. 13, 2009

(54) DEVICE USING REMOVABLE TEMPLATES TO PROVIDE ADJUSTABLE INTERACTIVE OUTPUT

(75) Inventor: Craig Hendrickson, Albany, CA (US)

(73) Assignee: LeapFrog Enterprises, Inc., Emeryville, CA (US)

( * ) Notice: Subject to any disclaimer, the term of this patent is extended or adjusted under 35 U.S.C. 154(b) by 618 days.

(21) Appl. No.: 10/966,242

(22) Filed: Oct. 15, 2004

(51) Int. Cl.
*A63H 30/00* (2006.01)

(52) U.S. Cl. ..... 446/175; 446/227

(58) Field of Classification Search ..... 446/175, 446/227–229
See application file for complete search history.

(56) References Cited

U.S. PATENT DOCUMENTS 5,254,007 A * 10/1993 Eagan ..... 434/319
5,813,861 A * 9/1998 Wood ..... 434/169
6,547,628 B1 * 4/2003 Long ..... 446/227
2002/0197587 A1 * 12/2002 Wood et al. ..... 434/159

* cited by examiner

*Primary Examiner*—Robert E Pezzuto
*Assistant Examiner*—Alex F. R. P. Rada, II

(57) ABSTRACT

An interactive device using removable templates to provide adjustable interactive output is disclosed. The interactive device includes a console unit, a plurality of electronic elements included in the console unit, and a plurality of movable elements included in the console unit. A controller is included in the console unit and is coupled to the electronic elements and is coupled to the movable elements. The controller is adapted to recognize a removable template on the console unit and control the electronic elements to provide an output related to the removable template and an actuation of the movable elements.

25 Claims, 6 Drawing Sheets

DEVICE USING REMOVABLE TEMPLATES TO PROVIDE ADJUSTABLE INTERACTIVE OUTPUT

TECHNICAL FIELD

Embodiments of the invention relate to interactive devices, appliances, toys, and the like.

BACKGROUND ART

Electronic devices, appliances, toys, and the like, that have the ability to produce noises and sounds have become extremely popular in recent years with students, children, etc. In this regard, a number of devices have been developed that produce sounds (e.g., speak or talk) when a child pushes a button on the device, and/or flash or otherwise turn on one or more lights of the device. For example, after pushing the button, a given device produces a prerecorded sound in conjunction with blinking/flashing one or more colored lights.

A number of electronic devices exist to facilitate a learning and/or entertainment experience for a user (e.g., child). For example, a device, appliance, toy, or the like, might have a button with the letter "E" printed on it. After a child presses the letter "E", the toy says the sound of the letter E (e.g., "eeee"). In one conventional electronic learning device, the device can respond to the user in a certain manner in order to reinforce a behavior (e.g., pressing letters in a certain manner, such as to spell a particular word).

Such toys could be improved. For example, over time, as a child grows up (e.g., from birth to 12 months, 18 months, 24 months, etc.) the child can become familiar with the responses from the toy. The child learns that by pushing on a certain part of the toy, the toy produces the same sound over and over again. The same set of buttons with the same corresponding set of sounds is always presented to the user. Consequently, learning and play can become predictable and repetitious. The child can lose interest in the toy and the educational and entertainment value of the toy to the child diminishes.

Another problem is the fact that the visual presentation of conventional toys become familiar to the child over time. A child becomes familiar with the look and feel of a toy. For example, a toy's look and feel encompasses its colors, the manner of its lights (e.g., flashing lights, blinking lights, etc.), its shapes and images, and the like. The child can become familiar with the look and feel of the toy, the manner of its behavior, and the way the child interacts with the toy. The child learns which interactive shapes or images produce which blinking/flashing lights and sounds. The same visual look is presented to the child, and consequently, over time the child looses interest in the toy.

Another problem with this type of toy is that the device typically includes subject matter having only a single level of intellectual difficulty. While a device having a single level of intellectual difficulty may be effective in maintaining the attention span of a child possessing a corresponding level of intelligence, it has been found that this type of device is not as effective in maintaining the attention span of children having higher or lower levels of cognitive development. For example, a child with a lower level of cognitive development than the intellectual level provided by a learning device of this type would become easily frustrated by the difficulty of the questions provided by the device. Likewise, a child having a higher level of cognitive development than the level provided by the device would become bored with the device because the questions are too easy. It would be desirable if an electronic toy had more functionality and more ways to stimulate and engage a child, both visually and audibly.

DISCLOSURE OF THE INVENTION

Embodiments of the present invention provide an interactive device using removable templates to provide adjustable interactive output experience. Embodiments of the present invention provide an electronic toy, appliance, device, or the like having more functionality, more customization options, and more adjustable interactive methods to stimulate and engage a child.

In one embodiment, the present invention is implemented as an interactive device comprising a console unit, a plurality of electronic elements (e.g., lights, speakers, etc.) included in the console unit, and a plurality of movable elements (e.g., paddles) included in the console unit. A controller (e.g., microcontroller, processor, state machine, etc.) is included in the console unit and is coupled to the electronic elements and to the movable elements. The controller is adapted to recognize a removable template on the console unit and control the electronic elements to provide an interactive output experience related to the removable template and an actuation pattern of the movable elements.

In one embodiment, the removable template comprises a plurality of translucent/transparent light regions. The light regions are located such that when the template is mounted on the console, the light regions are disposed substantially over the plurality of lights. The lights can flash in conjunction with sounds, music, or speech produced by a speaker of the console, in response to user interaction with the paddles, for instance. The controller is adapted to function with a number of such templates and provide a customized interactive output particular to each of the templates. The different interactive outputs are in accordance with, for example, different cognitive levels of the user, different learning objectives for the user, different ages for the user, or the like. In one embodiment, a particular template is automatically recognized by the device via a respective ID indicator of the template.

In one embodiment, the templates may be suitable for different, respective age groups and contain different images printed thereon. The images may be aligned with the light sources on the console.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE EMBODIMENTS

Reference will now be made in detail to the preferred embodiments of the present invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of embodiments of the present invention, numerous specific details are set forth in order to provide a thorough understanding of the present invention. However, it will be recognized by one of ordinary skill in the art that the present invention may be practiced without these specific details. In other instances, well-known methods, procedures, components, and circuits have not been described in detail as not to unnecessarily obscure aspects of the embodiments of the present invention.

NOTATION AND NOMENCLATURE

Some portions of the detailed descriptions which follow are presented in terms of procedures, steps, logic blocks, processing, and other symbolic representations of operations on data bits within a computer memory. These descriptions and representations are the means used by those skilled in the data processing arts to convey most effectively the substance of their work to others skilled in the art. A procedure, computer executed step, logic block, process, etc., are here, and generally, conceived to be self-consistent sequences of steps or instructions leading to a desired result. The steps are those requiring physical manipulations of physical quantities. Usually, though not necessarily, these quantities take the form of electrical or magnetic signals capable of being stored, transferred, combined, compared, and otherwise manipulated in a computer system. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present invention, discussions utilizing terms such as "processing," "computing," "configuring," "generating," or the like, refer to the action and processes of a microcontroller, computer system, or similar electronic computing device, that manipulates and transforms data represented as physical (electronic) quantities within registers and memories into other data similarly represented as physical quantities.

Embodiments of the Invention

Figure 1A:
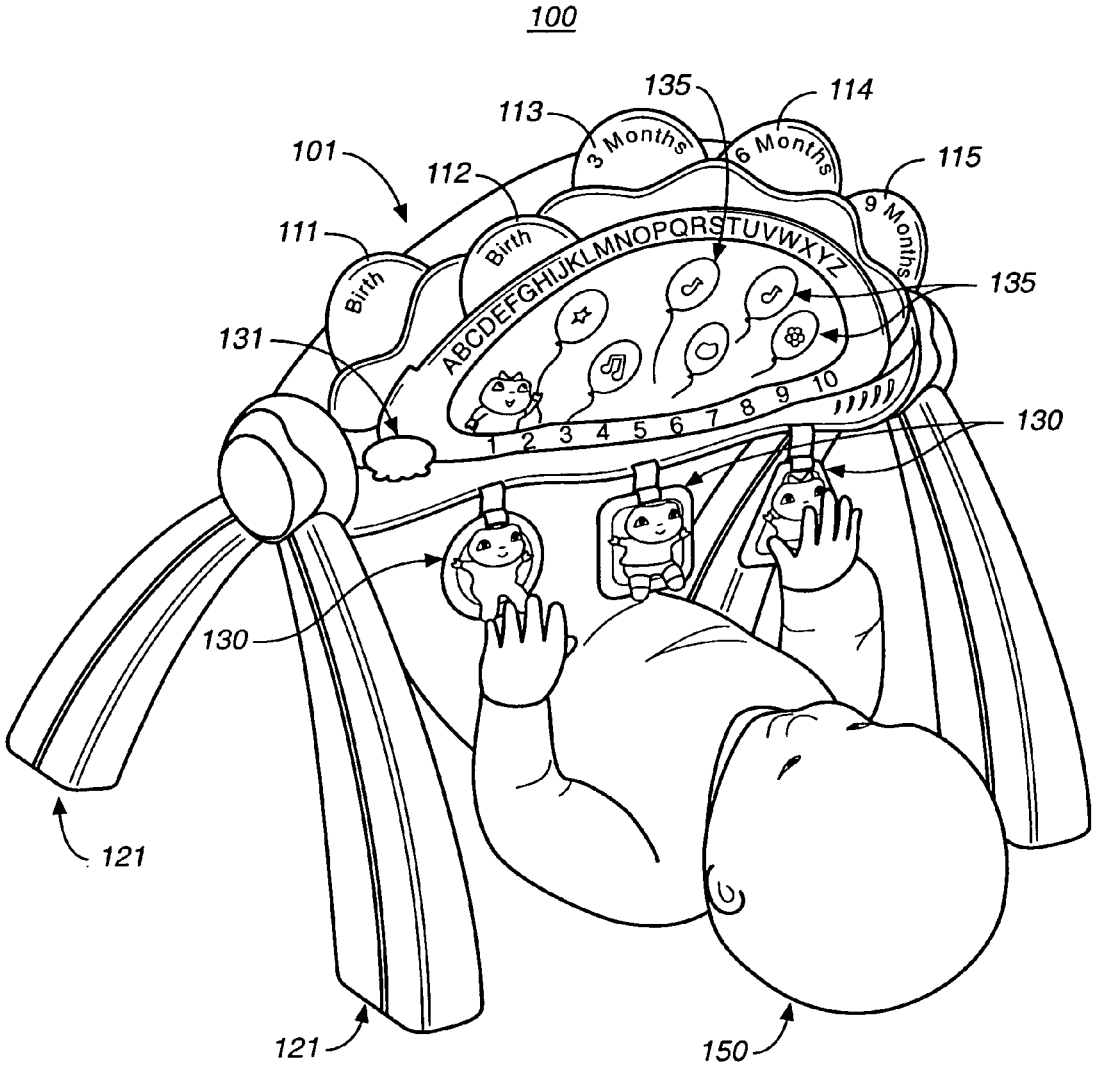
FIG. 1A shows a diagram depicting the console in an upright position in accordance with one embodiment of the present invention.

FIG. 1A shows a diagram depicting an interactive device 100 in an upright position in accordance with one embodiment of the present invention. As shown in FIG. 1A, the device 100 is shown in an upright position mounted on legs (e.g., legs 121) above the user 150 (e.g., a child).

The interactive device 100 of the present invention uses a plurality of removable templates 111-115 to provide adjustable interactive output. In so doing, the device 100 provides an electronic toy, appliance, device, etc. having more functionality, more customization options, and more adjustable interactive methods than the prior art to stimulate and engage a child.

In the system 100 embodiment of FIG. 1A, the interactive device 100 comprises a console unit 101 having a plurality of electronic elements. The electronic elements include lights and audio output devices (e.g. speakers). Six such lights 135 are indicated in FIG. 1A. A speaker 131 is also indicated. A plurality of movable elements 130 are included in, or otherwise connected to, the console unit 101 as shown. In the present embodiment, the movable elements 130 comprise three "paddles" that can be manipulated, pushed/pulled, or otherwise actuated by the child 150. In one embodiment, there is one respective light for each different position in which the paddle can be placed (e.g., push/pulled).

The system 100 embodiment provides an adjustable customizable interactive output experience for the child 150. This output experience adjusts in accordance with which of the removable templates 111-115 is active, and in accordance with the particular pattern/manner in which the paddles 130 are actuated by the child 150. Generally, the active template is positioned to the front of the console unit 101 and visible to the child 150.

In the system 100 embodiment, a removable template is active when it is inserted/mounted on the front of the console 101. Thus, in the example depicted in FIG. 1A, the template 112 is inserted on the front of the console 101 and thus is the active template (as opposed to be in a "holding position" at the rear or in the middle of the console 101, or by being totally removed).

The active template 112 is recognized by a controller within the console 101. Upon such recognition, the controller configures the console 101 to provide a predetermined interactive output that is specifically configured for, and designed to operate in conjunction with, the template 112. For example, the insertion of the template 112 as the front-most, or active, template causes the controller to configure the console 101 and control the electronic elements to provide an interactive output experience related to the removable template 112 and an actuation pattern of the paddles 130.

Figure 1B:
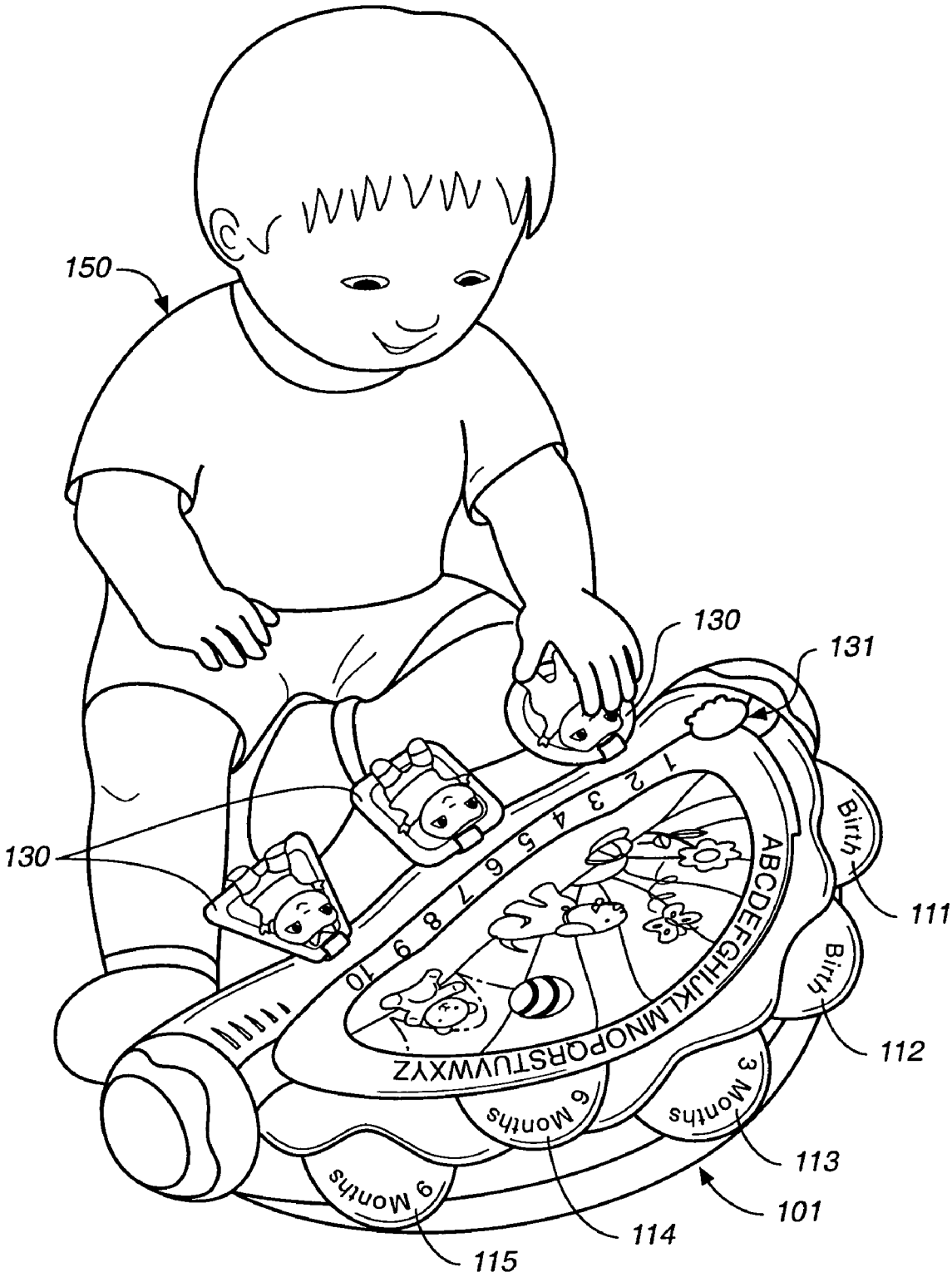
FIG. 1B shows a diagram depicting the console in a prone position (e.g., as opposed to an upright position) in accordance with one embodiment of the present invention.

FIG. 1B shows a diagram depicting the console 101 in a prone position (e.g., as opposed to an upright position) in accordance with one embodiment of the present invention. As shown in FIG. 1B, the legs (e.g., legs 121) have been removed from the console 101, thereby allowing the console 101 to lie flat on a horizontal surface (e.g. floor). Such a position can be helpful when the child 150 is old enough to sit upright. In operation, as the paddles are moved, depending on the active template, audio is played and the lights may illuminate different template images depending on the programming associated with the active template.

Figure 2:
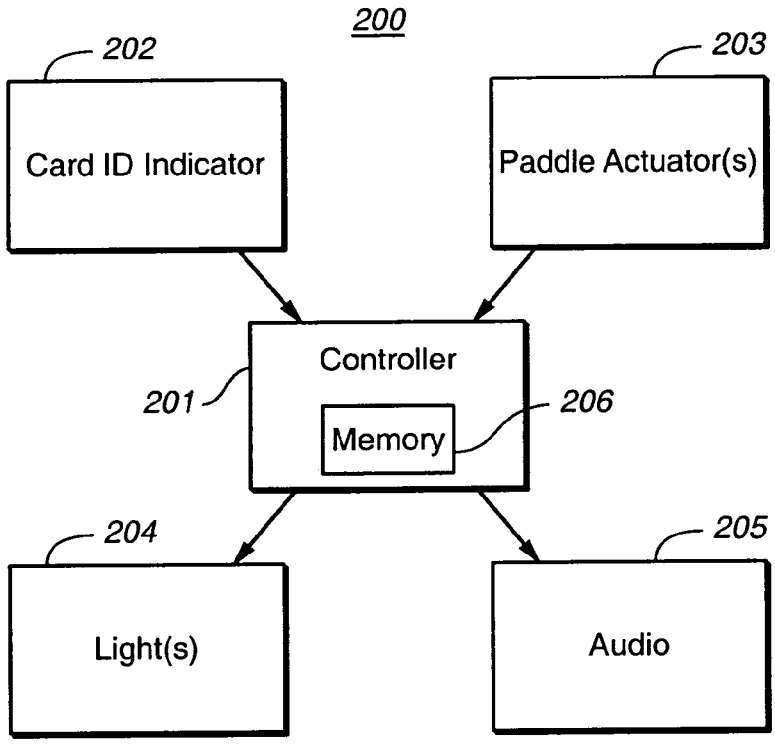
FIG. 2 shows a diagram illustrating an architecture in accordance with one embodiment of the present invention.

FIG. 2 shows a diagram illustrating an architecture 200 in accordance with one embodiment of the present invention. As shown in FIG. 2, system 200 includes a controller 201 coupled to receive input from a card ID indicator 202 and paddle sensors/actuators 203. The controller 201 is coupled to control the lights 204 and the audio output unit 205 to generate a desired interactive output, that is dependent on the active template.

The controller 201 is adapted to recognize a particular removable template (e.g., template 112) on the console unit 101 and control the electronic elements (e.g., lights 204 and/or audio 205) to provide an interactive output experience related to the particular removable template. Each template may have a respective program within the controller 201, which contains a computer readable memory 206. In the present embodiment, the particular removable template is recognized by the card ID indicator unit 202. This interactive output experience is also related to an actuation pattern of the paddle sensors 203 (e.g., the paddles 130 FIG. 1A).

Figure 3:
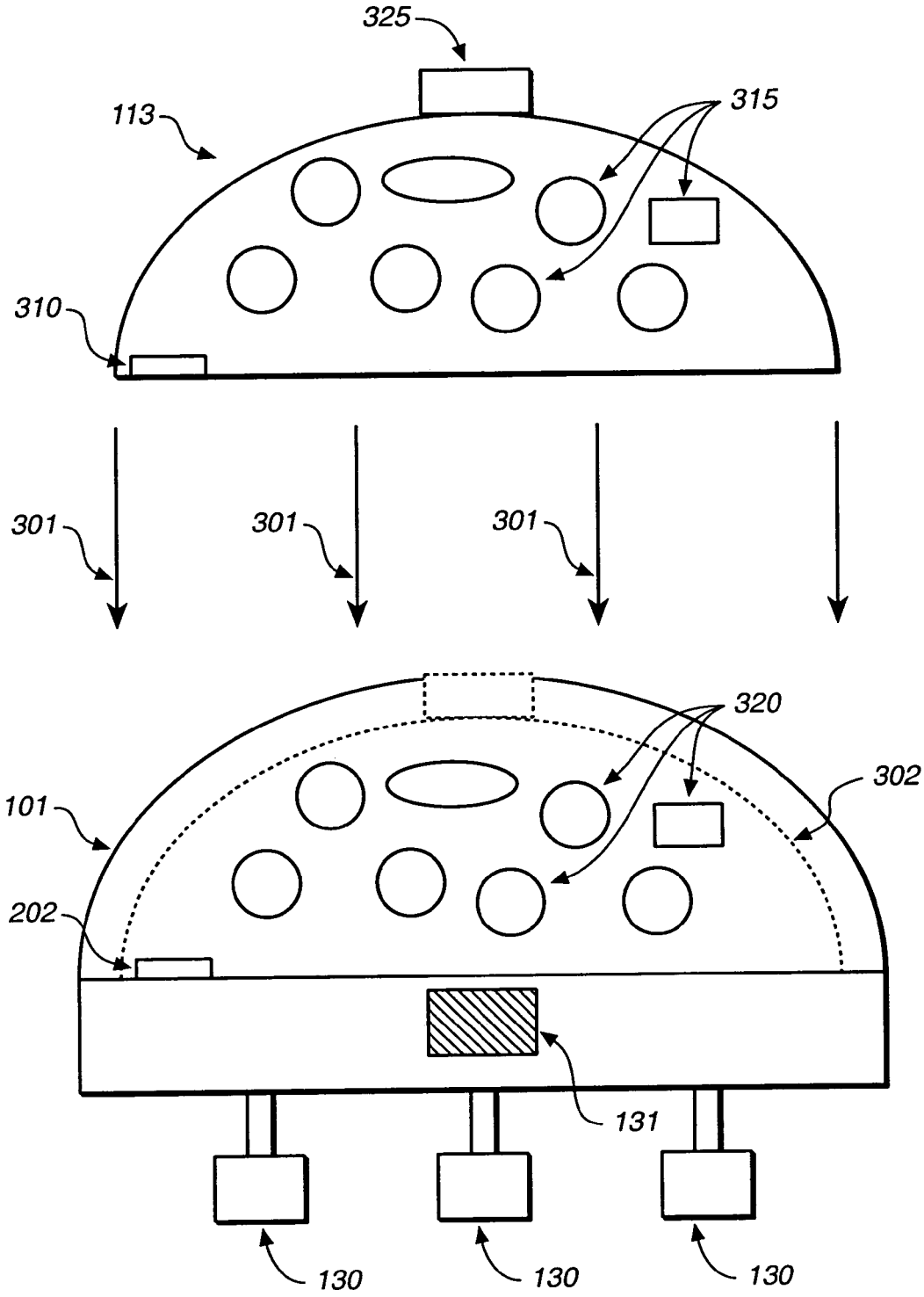
FIG. 3 shows a diagram illustrating a template insertion process in accordance with one embodiment of the present invention.

FIG. 3 shows a diagram illustrating a template insertion process in accordance with one embodiment of the present invention. As shown in FIG. 3, a template (e.g., template 113) is inserted/mounted into the console as indicated by the arrows 301, into the position shown by the dotted outline 302 of the template. Once in the mounted position, the template 113 is active. In the mounted position, a template ID 310 can be read by the card ID indicator 202 and thereby recognized by the controller 201.

In one embodiment, the template ID 310 comprises a pattern of holes perforated through the template 113 that can be recognized by the card ID indicator 202. The objective of the template ID 310 is too identify its particular template two the console 101 and the objective of the card ID indicator 202 is to read (or otherwise access/examine) the template ID 310 and perform the recognition or pass such information to the controller 201 so that it may perform the recognition.

It should be noted that in accordance with the above objectives, other embodiments of the template ID 310 and the card ID indicator 202 can be implemented. Such embodiments include, for example, using a printed barcode, a mechanical or electrical contact, ROM or flash memory, or the like as the template ID 310, and using a corresponding electronic or mechanical apparatus capable of reading the template ID 310 as the card ID indicator 202. In each case, it is desirable that the implementation of the template ID 310, and correspondingly the card ID indicator 202, be of sufficient ruggedness and durability so as to enable reliable and long-lived operation of the console 101 and the templates without imposing any excessive degree of cost or complexity.

In one embodiment, each of the removable templates comprises a plurality of translucent/transparent light regions 315. The light regions 315 are located such that when the template 113 is mounted on the console 101, the light regions 315 are disposed substantially over the plurality of lights 320. The light regions 315 may correspond to images that are highlighted to the user when the corresponding light is on. Images may be illuminated in synchronization with related audio.

In one embodiment, the template 113 includes a tab 325 for indicating an intended output for the template. For example, the tab could have printed information to inform a parent that the template is intended for children between the age of three months to six months. Similarly, the tab could have printed information to inform the parent that the desired learning objective is color recognition, counting, ABC's, or the like. In this manner, the tab 325 provides a quick visual reference to the parent indicating which particular removable template is active.

Figure 4:
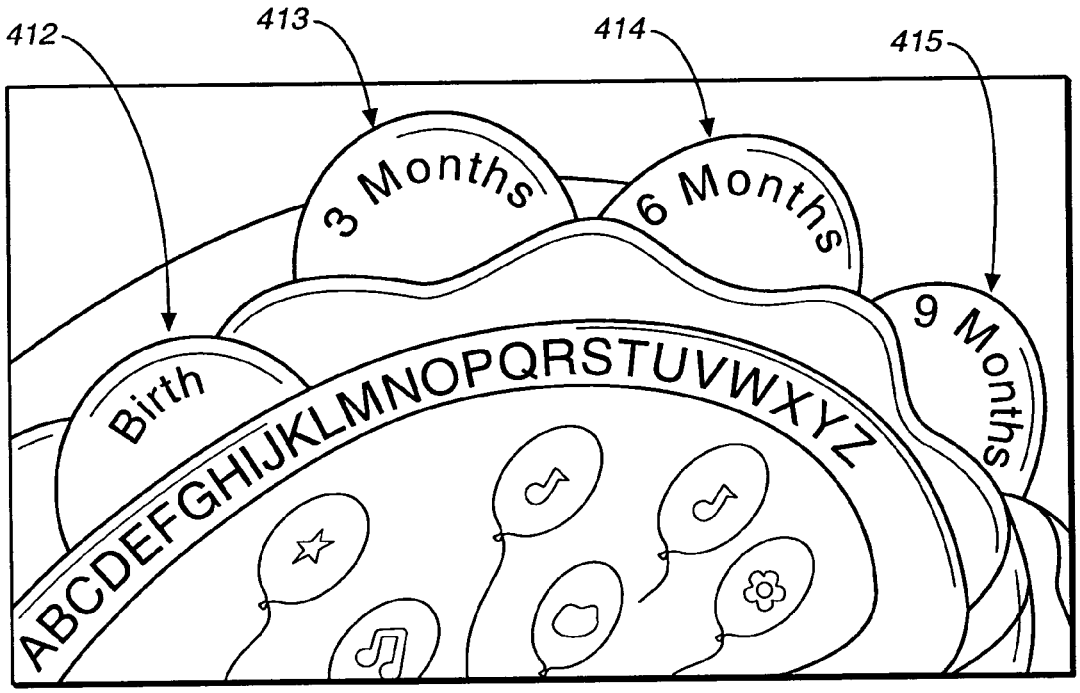
FIG. 4 shows a more detailed view of the tabs for the removable templates in accordance with one embodiment of the present invention.

FIG. 4 shows a more detailed view of the tabs 412-415 for the removable templates in accordance with one embodiment of the present invention. As described above, the tabs provide a quick visual reference to the parent indicating which particular removable template is active and the intended output for the template. For example, as shown in FIG. 4, the tab 412 indicates its associated template is for very young children (e.g. birth). The tab 413 indicates its associated template is for three-month-olds. The tab 414 indicates its associated template is for six-month-olds. The tab 415 indicates its associated template is for nine-month-olds, and so on.

As described above, the controller 201 is adapted to function with a number of such templates and provide a customized interactive output particular to each of the templates. The different interactive outputs are in accordance with, for example, different cognitive levels of the user, different learning objectives for the user, or the like.

Figure 5:
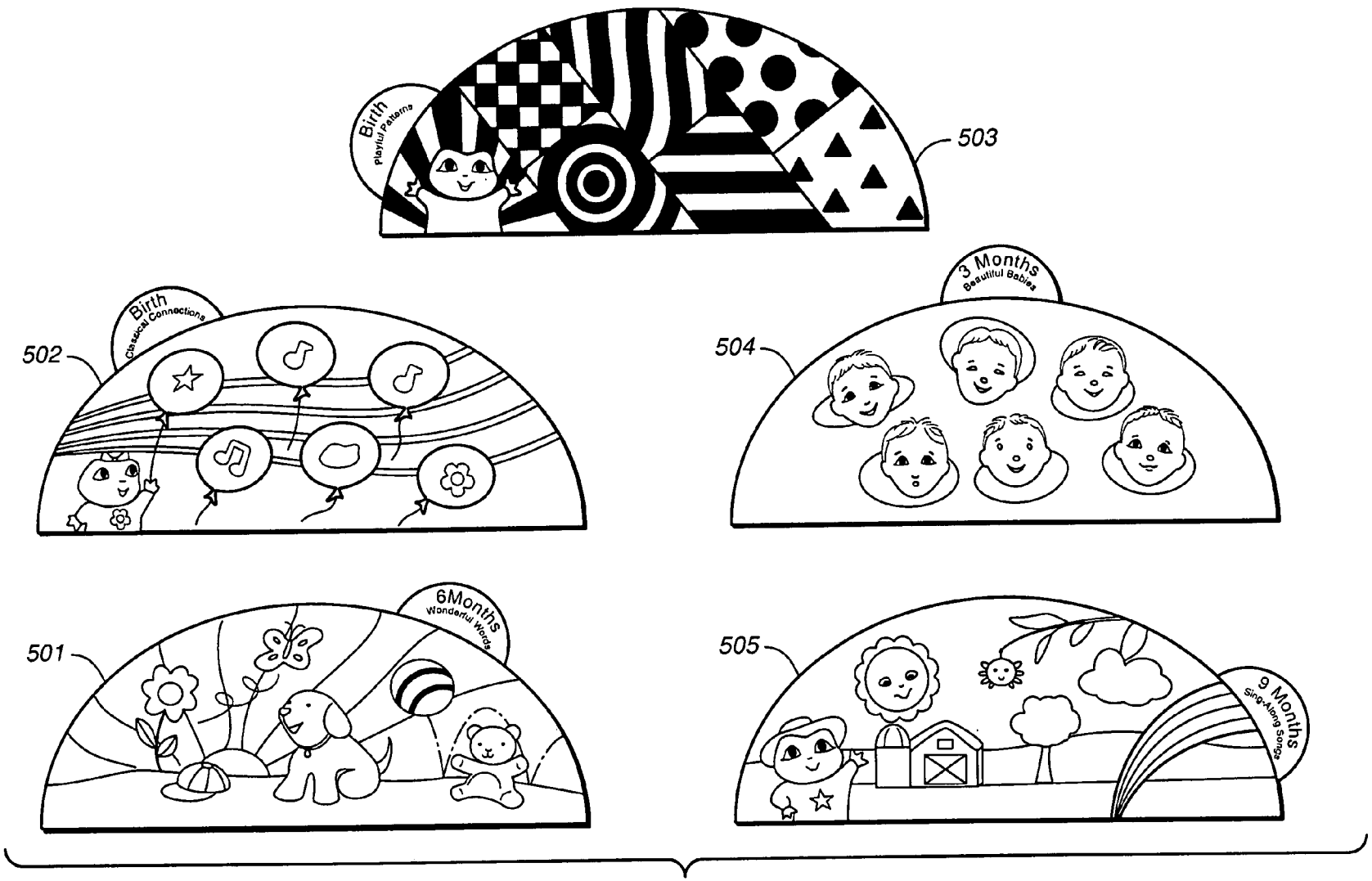
FIG. 5 shows a diagram illustrating a plurality of removable templates in accordance with one embodiment of the present invention.

FIG. 5 shows a diagram illustrating a plurality of removable templates 501-505 in accordance with one embodiment of the present invention. In one embodiment, each of the removable templates 501-505 comprise substantially planar elements (e.g., durable plastic sheets, etc.) configured to removably attach to the console 101. The templates allow a degree of light to pass there through to illuminate or highlight images when backlit.

For example, template 503 shows a basic template intended for very young children (e.g., birth) having a comparatively low cognitive ability. Template 503 includes basic black-and-white images through which the lights 320 shine in coordination with the beat of, for example, soothing classical music (e.g., from the speaker 131). For example, for this particular template, no physical interaction (e.g., through the paddles 130) may be required in order to cause output of the console 101. The mother can simply set a timer on the console. If however, the child starts touching the console 101, the controller 201 can detect such touching and adjust accordingly. Visually, the black-and-white patterns provide contrasts which encourage visual development. For example, the comparatively soothing music is configured to beat in synchronization with the lights which helps synchronize the mind of the child with rhythmic audio patterns.

Template 502 shows a template intended for slightly older children (e.g., three months). Visually, as color vision of the child develops at around two months, the template 502 implements colorful light regions configured to provide colorful visual stimuli. In this output configuration, upbeat active classical music can be produced by the speaker 131. The lights 320 connect with the rhythmic audio patterns of the music.

Template 504 shows a template for still older children (e.g., three months plus). At this stage, the motor skills of the child are such that the child readily touches and manipulates the paddles 130. Thus, the output for this template is correspondingly more complex. For example, visually, the template 504 can show images of real baby faces on a white background. The lights 320 respond to the child's interactions. Upbeat music combined with real baby coos and giggles can be produced by the speaker 131. Cognitively, template 504 takes advantage of the fact that babies generally respond favorably to looking at other baby faces.

Template 501 shows a template for children age six months plus. For example, at this stage, as a child sits upright at the console, the paddles 130 can be pressed manipulatively and directly connected with related images on the template and sounds produced by the speaker 131 (e.g., barking dog, etc.). Visually, the template can show images of items from the child's world in conjunction with upbeat music and phonemic sounds related to the images. Cognitively, such a template models a child's first words and connects images with their meaning.

Template 505 shows a template for children age nine months plus. For example, at this stage, the images of the template 505 are familiar objects from songs. The lights 320 function with the objects to encourage the early learning of the language and words of the song, encouraging the child to sing along.

In this manner, the removable templates 501-505 of the present invention yield a great degree of flexibility with respect to the growth stages of the child and the variety of activities implemented by the console 101. The interchangeable templates provide extended value, giving a child a number of different activities to perform with one electronic device/appliance/toy. The interchangeable templates allow a parent to choose the learning experience that is appropriate for her child's skills, abilities, and interests, thereby giving her a "toolkit" to help navigate through her child's first year of life. The ability to configure the console 101 as a sit-down toy or as an upright toy (e.g., mounted on legs) increases its flexibility.

Figure 6:
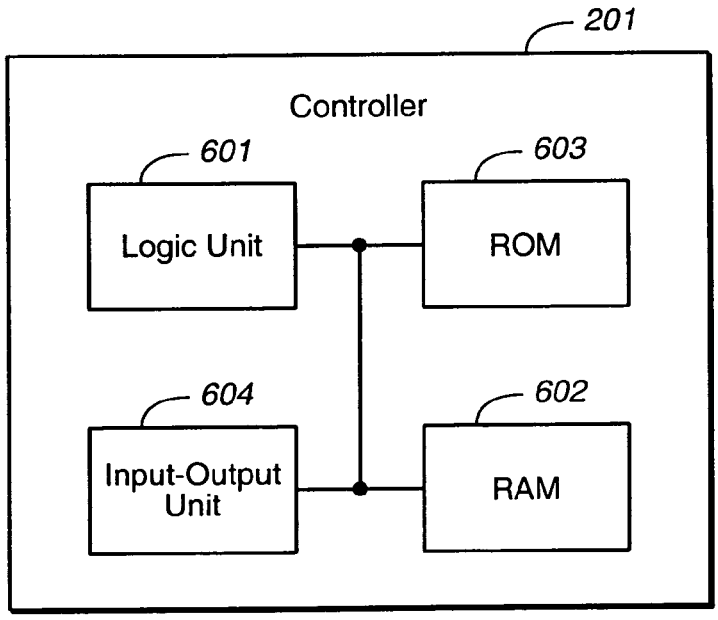
FIG. 6 shows the components of the controller in accordance with one embodiment of the present invention.

With reference now to FIG. 6, the components of the controller 201 in accordance with one embodiment of the present invention are shown. Controller 201 includes the basic components of a computer system in accordance with one embodiment of the present invention that provides the execution platform for implementing certain software-based functionality of the present invention. As described above, certain processes and steps of the present invention are realized, in one embodiment, as a series of instructions (e.g., software program) that reside within computer readable memory units of a computer system (e.g., controller 201) and are executed by the logic unit of the controller 201. When executed, the instructions cause the console 101 to implement the functionality of the present invention as described above.

In general, controller 201 comprises at least one logic unit 601 (e.g., processor, state machine, microcontroller, etc.) for processing information and instructions, a computer readable random access memory 602, (e.g., static RAM, dynamic RAM, etc.) for storing information and instructions for the logic unit 601, a computer readable non-volatile memory unit 603 (e.g., read only memory, programmable ROM, flash memory, EPROM, EEPROM, etc.) for storing static information and instructions, and a signal input/output unit 604 for communicating messages, command selections, data, etc., to and from the logic unit 601.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. An interactive device comprising:

a console unit;

a plurality of electronic elements included in the console unit, wherein the plurality of electronic elements comprises an audio output device and a plurality of lights;

a plurality of movable elements included in the console unit; and a controller included in the console unit and coupled to the electronic elements and coupled to the movable elements, wherein the controller is adapted to recognize a removable template on the console unit and control the electronic elements to provide an output related to the removable template and an actuation of the movable elements, wherein the plurality of movable elements are decoupled from the removable template and the movable elements are orientated substantially in parallel with the removable template and wherein the removable template comprises a plurality of light regions, wherein the plurality of light regions are substantially aligned with the plurality of lights to provide the output.

2. The device of claim 1, wherein a single removable template is usable at a single time.

3. The device of claim 2, wherein the audio output device is a speaker.

4. The device of claim 1, wherein the plurality of lights are adapted to provide the output in cooperation with the removable template.

5. The device of claim 1, wherein the controller is configured to provide a first output for a first removable template and to provide a second output for a second removable template.

6. The device of claim 5, wherein the controller is adapted to recognize the first removable template or the second removable template via a respective identification indicator located on the first or the second template.

7. The device of claim 5, wherein the first output is related to a first actuation pattern of the movable elements and the second output is related to a second actuation pattern of the movable elements.

8. The device of claim 7, wherein the first output is in accordance with a user having a first cognitive level, and the second output is in accordance with a user having a second cognitive level greater than the first cognitive level.

9. The device of claim 8, wherein the first output is in accordance with a first learning objective, and the second output is in accordance with a second learning objective.

10. The controller of claim 1, wherein the plurality of lights are adapted to provide the output in cooperation with the removable template.

11. The device of claim 1, wherein the interactive device is operable to be used in a horizontal orientation and a vertical orientation.

12. A controller for an interactive device, comprising:

a logic unit;

an input output unit; and a computer readable memory storing computer readable code which when executed by the logic unit cause the interactive device to implement a method comprising:

recognizing a removable template on the device;

sensing an actuation of a plurality of movable elements of the device, wherein the plurality of movable elements are decoupled from the removable template and are substantially parallel to the removable template; and generating an output related to the removable template and the actuation of the movable elements by controlling a plurality of electronic elements of the device, wherein the plurality of electronic elements comprises an audio output device and a plurality of lights and wherein the removable template comprises a plurality of light regions, wherein the plurality of light regions substantially align with the plurality of lights to provide the output.

13. The controller of claim 12, wherein the controller is operable to only be connected to a single template at a time.

14. The controller of claim 13, wherein the audio output device is a speaker.

15. The controller of claim 12, wherein the controller is configured to provide a first output for a first removable template and to provide a second output for a second removable template.

16. The controller of claim 15, wherein the controller is adapted to recognize the first removable template or the second removable template via a respective identification indicator located on the first or the second template.

17. The controller of claim 15, wherein the first output is related to a first actuation pattern of the movable elements and the second output is related to a second actuation pattern of the movable elements.

18. The controller of claim 17, wherein the first output is in accordance with a user having a first cognitive level, and the second output is in accordance with a user having a second cognitive level greater than the first cognitive level.

19. The controller of claim 18, wherein the first output is in accordance with a first learning objective, and the second output is in accordance with a second learning objective.

20. A template for an interactive device, comprising:

a substantially planar element configured to removably attach to the interactive device;

a plurality of output regions included in the planar element; and an identification indicator included in the planar element, wherein the identification indicator configures a controller of the interactive device to control a plurality of lights, at least one speaker, and respond to a plurality of movable elements of the interactive device to provide an output related to the template and an actuation of the movable elements, wherein the plurality of output regions are image-bearing light regions disposed substantially over the plurality of lights and wherein the substantially, planar element is operable to be substantially in parallel with the plurality of movable elements and wherein the template causes the controller to generate a predetermined one of a plurality of outputs configured for the template.

21. The template of claim 20, wherein the substantially planar element is operable to be the only substantially planar element to be attached to the interactive device at one time.

22. The template of claim 20, wherein the template is removable from the device and is adapted cause the controller to reconfigure for the template upon attachment of the template to the device.

23. The template of claim 20, wherein the template is in accordance with a predetermined cognitive level of a user.

24. The template of claim 20, wherein the template is in accordance with a predetermined learning objective of a user.

25. The template of claim 20, wherein the template comprises a tab for indicating an intended output for the template.

* * * * *